US005597364A

United States Patent [19]

Thompson

[11] Patent Number: 5,597,364

[45] Date of Patent: Jan. 28, 1997

[54] GOLF PUTTER

[76] Inventor: James M. Thompson, 12 Snowberry Ct., Hunt Valley, Md. 21030

[21] Appl. No.: 592,841

[22] Filed: Jan. 22, 1996

[51] Int. Cl.[6] ..... A63B 53/04

[52] U.S. Cl. ..... 473/314; 473/328; 473/330; 473/340

[58] Field of Search ..... 473/340, 328, 473/327, 330, 313, 251, 324, 341, 314, 334, 336, 256, 305; D21/217, 219

[56] References Cited

U.S. PATENT DOCUMENTS

| | | | |
|---|---|---|---|
| D. 199,850 | 12/1964 | Taylor | D21/219 |
| 1,703,199 | 2/1929 | McClure . | |
| 2,665,909 | 1/1954 | Wilson | 473/330 |
| 3,068,011 | 12/1962 | Sano . | |
| 3,081,087 | 3/1963 | Redd . | |
| 3,399,898 | 9/1968 | Burkland | 473/340 |
| 3,693,978 | 9/1972 | East . | |
| 4,065,133 | 12/1977 | Gordos | 473/328 |
| 4,314,701 | 2/1982 | Swanson . | |
| 4,508,350 | 4/1985 | Duclos . | |
| 4,529,202 | 7/1985 | Jacobson . | |
| 4,861,038 | 8/1989 | Fucinato | 473/328 |
| 4,872,684 | 10/1989 | Dippel | 473/330 |
| 4,881,737 | 11/1989 | Mullins | 473/330 |
| 4,919,428 | 4/1990 | Perkins . | |
| 4,960,279 | 10/1990 | Harris, Jr. . | |
| 5,090,698 | 2/1992 | Kleinfelter . | |
| 5,193,806 | 3/1993 | Burkly | 473/313 |
| 5,433,441 | 7/1995 | Olsen et al. . | |

OTHER PUBLICATIONS

Competitive Edge Golf, Summer 1994, p. 17, 526 West 26th St., 10th Floor, New York, NY 10001.

*Primary Examiner*—Sebastiano Passaniti
*Attorney, Agent, or Firm*—Leonard Bloom

[57] ABSTRACT

A golf putter having a cylindrical head having a diameter substantially equal to the diameter of a golf ball, with symmetrical characteristics of the axis of the shaft intersecting both the axis of the head and the mid-point of the head. This design also incorporates counterbores at either end of the head and slots across the bottom of the cylinder head parallel to the direction of movement of the head. To reduce resistance with either the ball or the putting surface, the head may also be coated with a friction reducing material such as Teflon.

14 Claims, 4 Drawing Sheets

GOLF PUTTER

BACKGROUND OF THE INVENTION

The present invention relates to a golf putter and in particular to a golf putter having a cylindrical head, a center of mass at the midpoint of the head, and a plurality of grooves formed in the bottom of the head.

Unlike the other types of golf club heads as "woods" and "irons" which are all basically similar in design, putters tend to have an almost unlimited variety of designs primarily because putting is more of a personal preference for each individual golfer as opposed to the intended use of the other two types.

U.S. Pat. No. 1,703,199, McClure, discloses a symmetrical club head with its center of gravity directly at the end of the shaft aiding in achieving a pendulum-like swing. This design however is of the blade-like design, that is having a flat surface where the club head impacts the ball and a shaft offset from the center line of the head.

U.S. Pat. No. 3,068,011, Sano, discloses "U" shaped plates on the bottom of wood-type and iron-type golf clubs. Arc shaped grooves are provided between the fork of the "U". The golf clubs are of conventional shape.

U.S. Pat. No. 3,081,087, Redd, discloses a golf club mechanically balanced with respect to the center line of the shaft. A longitudinal, tapered hole extends through the club and the club has a blade-like face.

U.S. Pat. No. 3,693,978, East, discloses a club head design with a center of gravity coincident-with its geometric center, however the design is for "woods" rather than for irons or putters. The face is of a flat design as opposed to cylindrical.

Swanson, U.S. Pat. No. 4,314,701, discloses a putter design having a generally rectangular blade head with a front putting face, a substantially flat rocker bottom, an upright back wall and a central cylindrical portion having a diameter matching the diameter of a golf ball. Longitudinal grooves are formed in the top of the blade for sighting purposes.

Duclos, U.S. Pat. No. 4,508,350 discloses a putter with a flat blade design and a head having a high polar moment of inertia above the preferred ball striking point.

U.S. Pat. No. 4,529,202, Jacobson, discloses a putter having a blade member with a wide, planar upper surface with disc like members on opposite ends of the blade member.

Perkins, U.S. Pat. No. 4,919,428, discloses a putter having a transversely elongated head with an upright front wall. Tracking grooves are formed on the bottom face.

Olsen, U.S. Pat. No. 5,433,441 discloses a putter with a cylindrical head having a diameter smaller than the diameter of a golf ball. A mushroom shaped end cap is attached to either side of the head.

A putter advertised under the name "Masteroll" in the publication "Competitive Edge Golf" is cylindrical but "is designed to strike the ball slightly above center" and is larger in diameter than the ball. The shaft is not aligned with the heel but is off-set to "keep your hands in front of the ball".

Thus, although many types of golf putters have been proposed and marketed, there still exists a need for a golf putter which can enable the golfer to impact the center of mass of the club head directly on the center of mass of the golf ball to provide greater control of the movement of the golf ball.

BRIEF SUMMARY OF THE INVENTION

It is an object of the present invention to provide a golf putter which is symmetrical and cylindrical such that the center of mass of the head is disposed at the end of the shaft so that the golfer has direct control over the putter with respect to the ball.

It is a further object of the present invention to provide a golf putter which has a diameter equal to the diameter of the golf ball to effect a maximum transmission of energy when the putter strikes the ball.

In accordance with the teachings of the present invention, there is disclosed a golf putter for hitting a golf ball having a diameter. The putter includes a cylindrical head having a diameter substantially equal to the diameter of the golf ball. The head has a circumference, a top, a bottom, a face, an opposite back, a toe, an opposite heel, a midpoint between the toe and the heel and the top and the bottom. A center of mass is disposed at the midpoint. A bore is formed in the top of the head. The bore has a longitudinal axis extending to the center of mass of the head. The bore forms an angle ranging from 14° to 22° with respect to a vertical axis between the top and the bottom. The bore is oriented from the center of mass toward the heel. A shaft is disposed in the bore and extends outwardly therefrom. A grip is connected to the shaft. The toe and the heel each have a respective frusto-conical counterbore formed therein. A plurality of spaced apart parallel slots are formed circumferentially in the bottom of the head. Each slot has a length approximately one-fifth to one-quarter of the circumference of the head. A friction reducing coating may be disposed on the head. The head is symmetrical such that the face and the back are identical and the golf putter can be used by both a right hand golfer and a left hand golfer. When the golf putter is swung, the center of mass of the head is directed toward the golf ball to impart maximum impact thereto and the center of mass of the head is in line with the shaft permitting control by the golfer.

These and other objects of the present invention will become apparent from a reading of the following specification, taken in conjunction with the enclosed drawings.

DESCRIPTION

Referring now to the figures, the golf putter 10 of the present invention has a head 12 from which extends a shaft 14 with a grip 16 on the end of the shaft 14 opposite from the head 12.

Figure 1:
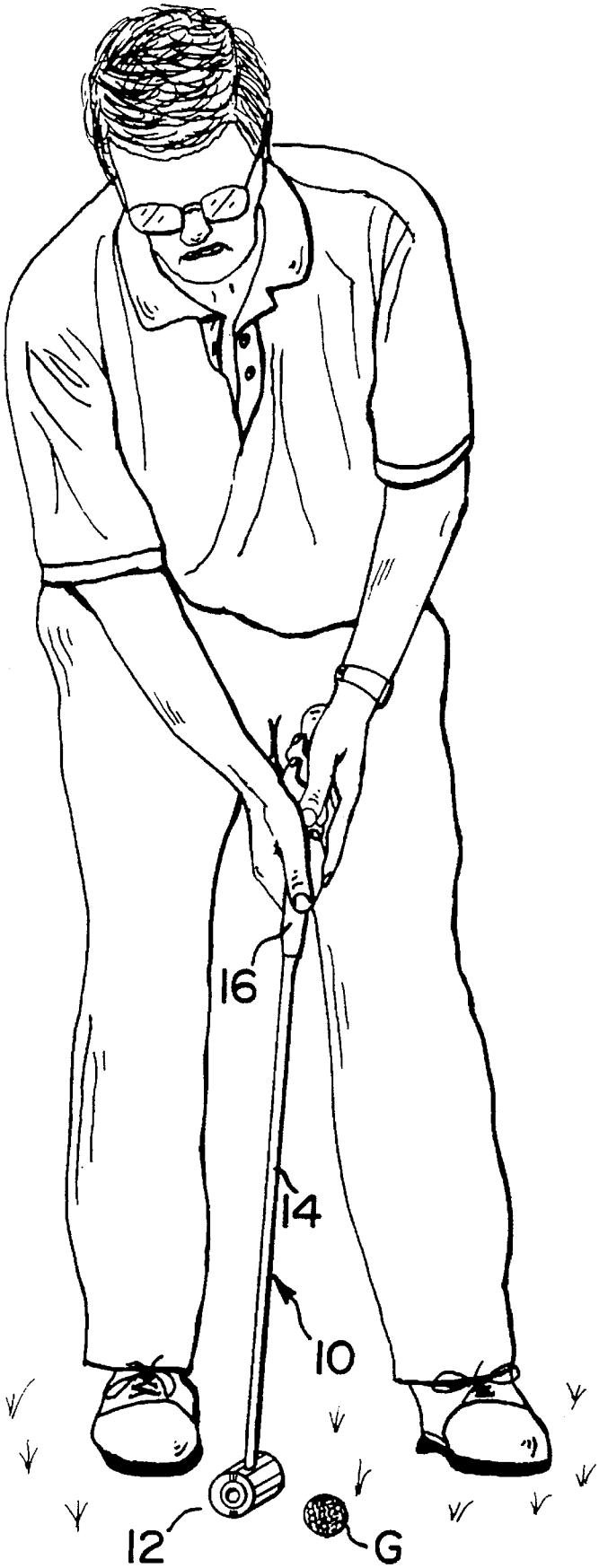
FIG. 1 is a perspective view of a golfer using the golf putter of the present invention.
Figure 2:
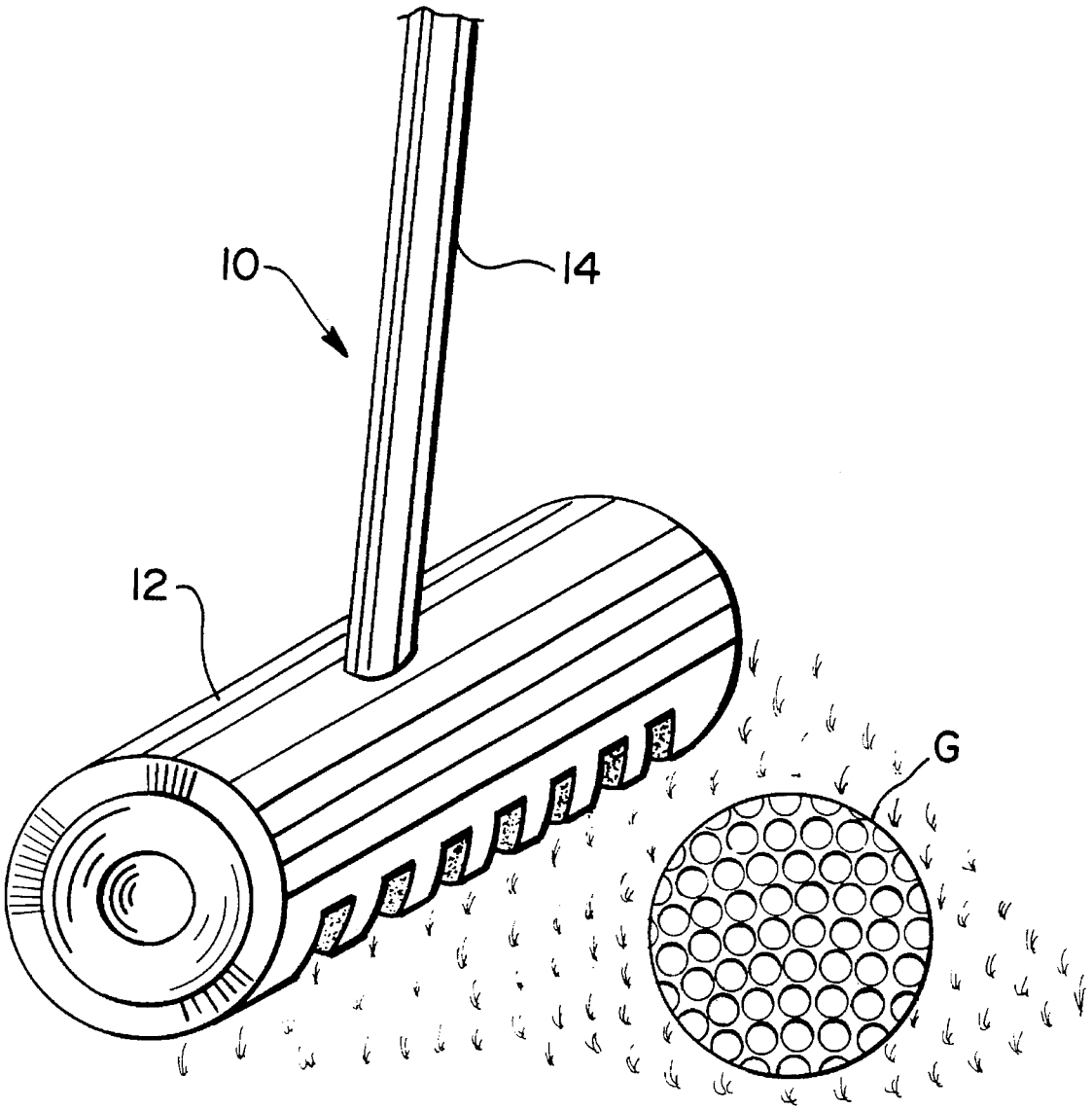
FIG. 2 is a perspective view of the golf putter of the present invention striking a golf ball.

The head 12 is cylindrical and has a diameter substantially equal to the diameter of the golf ball G. Preferably, the diameter is in the range of 1.60 to 1.75 inches (FIG. 2). The head 12 has a top 18, a bottom 20, a face 22, a back 24 opposite to the face 22, a toe 26, and a heel 28 opposite the toe 26. A midpoint 30 is located centrally in the head 12 between the toe 26 and the heel 28 and also between the top 18 and the bottom 20. The midpoint 30 is at the intersection of a lateral axis between the heel 28 and the toe 26 and a vertical axis between the top 18 and the bottom 20. The center of mass of the head 12 is located at the midpoint 30. It is preferred that the head 12 be made of a strong light weight material such as aluminum or magnesium.

A bore 32 is formed in the top 18 of the head 12. The bore 32 has a longitudinal axis 34 which extends angularly to the center of mass of the head 12. The longitudinal axis 34 of bore 32 forms an angle ranging from 14° to 22° with respect to a vertical axis 36 between the top 18 and the bottom 20 of the head 12. The bore 32 is oriented from the center of mass toward the heel 28.

Figure 3:
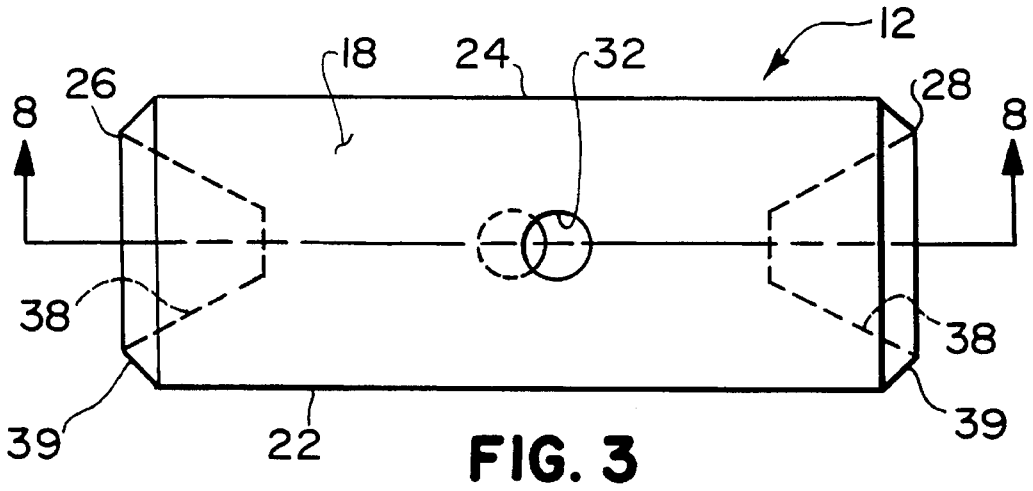
FIG. 3 is a top plan view of the head of the present invention.
Figure 4:
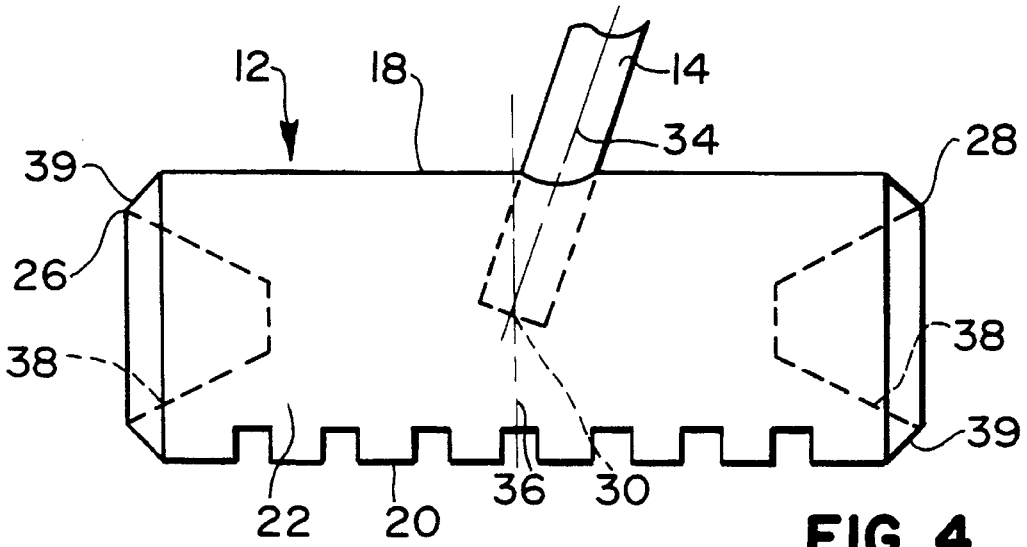
FIG. 4 is a side elevation view of the head of the present invention.
Figure 5:
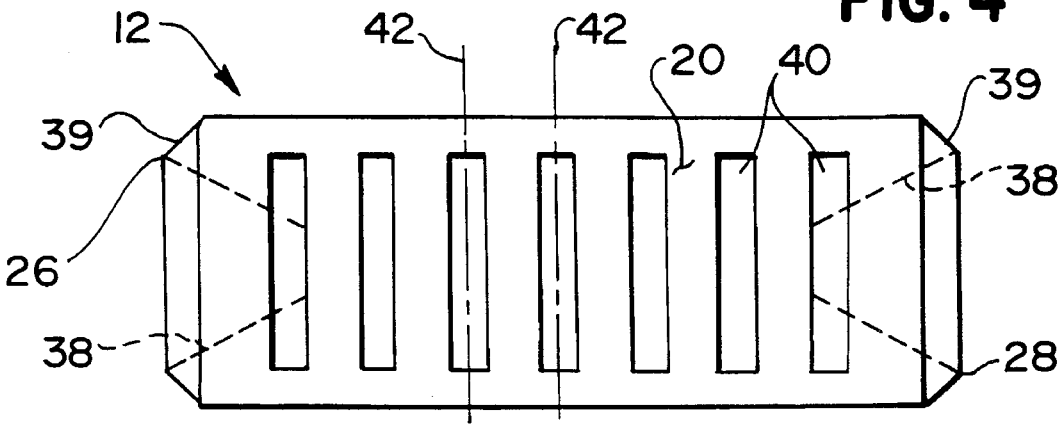
FIG. 5 is bottom plan view of the head of the present invention.
Figure 8:
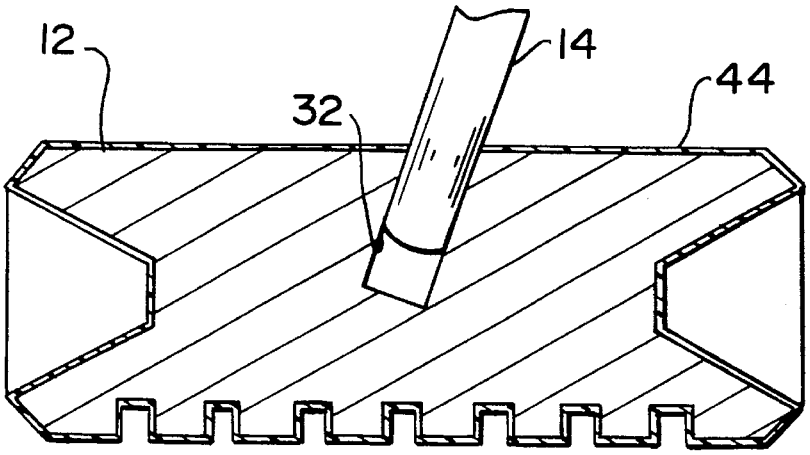
FIG. 8 is a cross section view taken along the lines 8—8 of FIG. 3 showing the friction reducing coating drawn to an enlarged scale.

The shaft 14 is disposed in the bore 32 and extends outwardly from the bore 32 and the top 18 of the head 12. Preferably, the shaft 14 is in-line with the heel 28 such that the head 12 is symmetrically disposed on either side of shaft 14. The shaft 14 may be disposed the full length of the bore 32 to the center of mass but it is not necessary. The shaft 14 need be disposed in the bore 32 only to a sufficient length to assure retention of the head 12 on the shaft 14. The orientation of the shaft 14 and the bore 32 with respect to the center of mass is significant in that the present invention places the center of mass effectively at the end of the shaft (FIG. 3, 4 and 8). Since most golfers utilize a pendulum-like movement when putting, placing the center of mass of the head 12 effectively directly at the end of the shaft 14 makes a pendulum-like motion easier for the golfer to achieve.

The toe 26 and the heel 28 each have a counterbore 38 formed therein directed toward the center of mass to reduce the total weight of the head 12 and to concentrate the mass of the head centrally at the center of mass (FIGS. 3–8). The counterbores are each identical in size and shape and, preferably, are frustoconical, although this shape is not limiting. It is further preferred that the heel 28 and the toe 26 each be tapered 39 at an angle of approximately 45° from the distal ends of the head 12 toward the outer surface of the head 12. The taper 39 extends completely around the circumference of the head 12.

Figure 6:
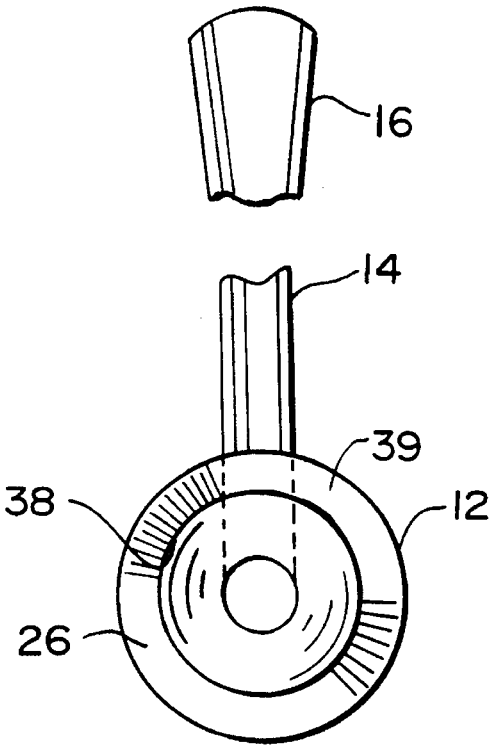
FIG. 6 is an end view of the toe of the present invention.
Figure 7:
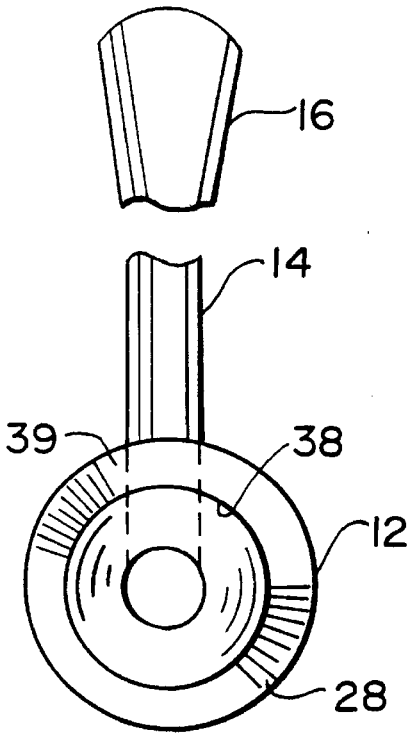
FIG. 7 is an end view of the heel of the present invention.

A plurality of spaced-apart parallel slots 40 are formed in the bottom 20 of the head 12 (FIGS. 4, 6 and 18). Preferably, each slot 40 has a center line 42 and the center lines are equispaced approximately one-half (½) inch from the center line 42 of the adjoining slot 40. The slots may be of any shape but preferably are approximately one-quarter (¼) inch wide and one-quarter (¼) inch deep. Thus, in a golf putter 10 having a head of approximately three and one-half (3.5) to four (4) inches in length between the toe 26 and the heel 28, a plurality of slots (7 shown) are formed in the bottom 20 of the head 12. The length of the arc described by each slot is approximately one and one-quarter (1.25) inches. Thus the slots cover approximately 22.75 to 25% of the circumference of the head 12. The slots are parallel to the direction of movement of the head 12 when the golf putter 10 is swung by a golfer.

The slots in the bottom of the cylindrical head 12 are significant in that they assist the golfer in striking the golf ball "squarely" in line with the direction of the pendulum-like arc of the swing. In addition to helping keep an accurate line, the slots also cushion the impact of the putter should it strike the turf too low prior to impacting the ball and minimize any "drag" on the putter or bounce from putting against the grain of the grass. The addition of these slots also enable the golfer to utilize this putter in situations where the ball lies in grass slightly longer than is found on the green, as in the area known as the "fringe" or "first cut."

The curved bottom of the putter resulting from its cylindrical design also has a positive effect with regard to minimizing drag or bounce.

To reduce resistance with either the ball or the putting surface, the head 12 may be coated with a friction reducing material 44 such as TEFLON®.

All of the design elements of the golf putter 10 of the present invention have the specific intent of enabling the golfer to impact the center of mass of the head 12 directly on the center of mass of the golf ball, with the resulting action emulating the action of two round objects striking each other at each other's respective center of mass. This is not unlike the resulting action observed in billiards or pool and similar to the resulting action of a cylindrical baseball bat as it impacts the round baseball. Making the head 12 cylindrical and substantially equal to the diameter of the golf ball is significant in this respect in that the design enables the golfer to impart maximum impact between the head 12 of the golf putter 10 and the golf ball. Making the axis of the shaft 14 intersect the axis of the cylindrical head 12 precisely at the mid-point of the head 12 is also significant, as it places the center of mass of the head 12 directly at the end of the shaft so that the golfer has complete control over the head 12 and, consequently over the golf ball.

The head of the golf putter 10 is symmetrical on each side of the shaft 14 such that the face 22 is identical with the back 24 of the head 12. Thus, the golf putter 10 of the present invention can be used by a right hand golfer and by a left hand golfer. The face 22 and back 24 of the same golf putter when used by a right hand golfer become, respectively, the back 24 and face 22, when used by a left hand golfer. With either right hand or left hand use, the shaft 14 is preferably oriented directly above and in line with, the heel 28 and is not offset toward either side.

I claim:

1. A golf putter for hitting a golf ball having a diameter, the putter comprising:

a cylindrical head having a diameter substantially equal to the diameter of the golf ball, the head having a top, a bottom, a face, an opposite back, a toe, an opposite heel, a midpoint between the toe and the heel and between the top and the bottom, wherein a center of mass is located at the midpoint, a bore formed in the top of the head, the bore having a longitudinal axis extending to the center of mass of the head, the bore being angled from the center of mass toward the heel, a shaft disposed in the bore and extending outwardly therefrom, a grip connected to the shaft, wherein, when the golf putter is swung, the center of mass of the head is directed to the center of mass of the golf ball to impart maximum impact thereto and further wherein the center of mass of the head is in line with the shaft permitting control by a golfer, and a plurality of spaced apart parallel slots formed circumferentially in the bottom of the head.

2. The golf putter of claim 1, wherein the toe and the heel each have a respective counterbore formed therein such that the weight of the golf putter is reduced and the center of mass is concentrated at the midpoint of the head.

3. The golf putter of claim 2, wherein each counterbore is frusto-conical.

4. The golf putter of claim 1, wherein each of said slot is approximately ¼ inch wide and ¼ inch deep.

5. The golf putter of claim 1, wherein each of said slots has a center line and the spacing between the center lines of each parallel slot is approximately one half inch.

6. The golf putter of claim 1, wherein the head is symmetrical such that the face and the back are identical and the golf putter can be used by a right hand golfer and a left hand golfer.

7. The golf putter of claim 1, wherein the length of the arc described by each of said slots is approximately one and one-quarter (1.25) inches.

8. The golf putter of claim 1, wherein the diameter of the head is in the range of 1.60 to 1.75 inches.

9. The golf putter of claim 1, wherein the longitudinal axis of the bore in the top of the head is at an angle ranging from 14° to 22° with respect to a vertical axis between the top and bottom of the head.

10. The golf putter of claim 1, further comprising the head having a friction reducing coating thereon.

11. The golf putter of claim 1 wherein the shaft is in line with the longitudinal axis of the cylindrical head.

12. A golf putter for putting a golf ball having a diameter, the putter comprising;

a cylindrical head having a diameter substantially equal to the diameter of the golf ball, the head having a top, a bottom, a toe and an opposite heel, a bore formed in the top of the head extending angularly towards the center of mass of the head to a mid-point between the toe and the heel, the bore being oriented toward the heel, a shaft disposed in the bore and extending outwardly therefrom, the toe and the heel each having a respective counterbore formed therein to reduce the total weight of the head and to concentrate the mass of the head centrally at the center of mass, and a plurality of parallel, spaced apart grooves formed circumferentially in the bottom of the head for assisting a golfer in striking the golf ball squarely in line with the direction of the swing and dimensioned to minimize drag on the putter from putting against the grain of the grass on a putting surface.

13. A golf putter for hitting a golf ball comprising, a cylindrical head having a top, a bottom, a toe, an opposite heel, a midpoint between said toe and heel, a lateral axis between said toe and heel, a vertical axis between said top and bottom, wherein a center of mass of the head is disposed at the mid-point at the intersection of the lateral axis with the vertical axis, a bore formed in the top of the head, the bore having a longitudinal axis extending to the center of mass of the head, the bore being angled from the center of mass toward the heel, a shaft disposed in the bore and extending outwardly therefrom, a grip connected to the shaft, a plurality of spaced apart parallel slots formed circumferentially in the bottom of the head, each slot having a center line, the center lines being approximately one-half inch apart, each slot being approximately one-quarter inch wide and approximately one-quarter inch deep.

14. A golf putter for hitting a golf ball having a diameter, the putter comprising:

a cylindrical head having a diameter substantially equal to the diameter to the diameter of the golf ball, the head having a circumference, a top, a bottom, a face, an opposite back, a toe, an opposite heel, a midpoint between said toe and heel and between said top and bottom wherein a center of mass of the head is disposed at said midpoint, a bore formed in the top of the head, the bore having a longitudinal axis extending angularly to the center of mass of the head, the bore forming an angle ranging from 14° to 22° with respect to a vertical axis between the top and the bottom and the bore being oriented from the center of mass toward the heel, a shaft disposed in the bore and extending outwardly therefrom, a grip connected to the shaft, the toe and heel each having a respective frusto-conical counterbore formed therein, a plurality of spaced-apart parallel slots formed circumferentially in the bottom of the head, each slot having a length approximately one-fifth to one-quarter of the circumference of the head, a friction reducing coating on the head, the head being symmetrical such that the face and the back are identical and the golf putter can be used by both a right hand golfer and a left hand golfer, and wherein when the golf putter is swung, the center of mass of the head is directed toward the center of mass of the golf ball to impart maximum impact thereto and further wherein the center of mass of the head is in line with the shaft permitting control by the golfer.

* * * * *